US005165594A

United States Patent [19]

Kissinger

[11] Patent Number: 5,165,594

[45] Date of Patent: Nov. 24, 1992

[54] TITHING BANK APPARATUS

[76] Inventor: Janet M. Kissinger, 2820 Ross Ave., Baltimore, Md. 21219

[21] Appl. No.: 797,450

[22] Filed: Nov. 21, 1991

[51] Int. Cl.[5] ..... A47G 29/00

[52] U.S. Cl. ..... 232/4 R; 446/10

[58] Field of Search ..... 446/8-13; 232/1 D, 4 R; 206/0.8, 0.84

[56] References Cited

U.S. PATENT DOCUMENTS 1,456,227 5/1923 Fisher ..... 232/4 R
3,992,805 11/1976 Arkin ..... 446/8
4,756,406 7/1988 Grounds ..... 232/4 R X

*Primary Examiner*—Mickey Yu
*Attorney, Agent, or Firm*—Leon Gilden

[57] ABSTRACT

A tithing bank is provided for religious training and personal association of an individual to a tithing situation. The bank structure includes a floor, with the bank defined by simulation of a bible book, including a slot arrangement to direct a percentage of money to a tithing portion and a remaining percentage to a savings portion relative to an individual. A modification of the invention includes an adjustable partition wall arranged to deflect in an adjustable manner various percentages of savings to tithing.

4 Claims, 4 Drawing Sheets

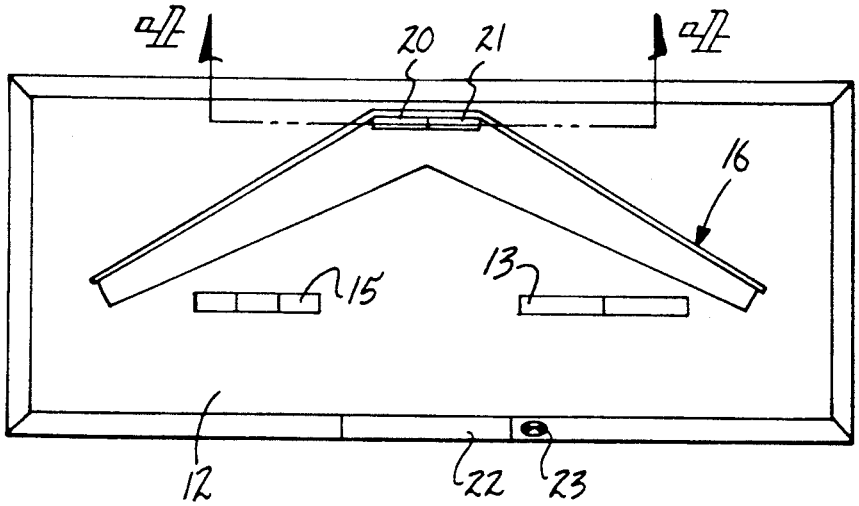
FIG 2
FIG 3
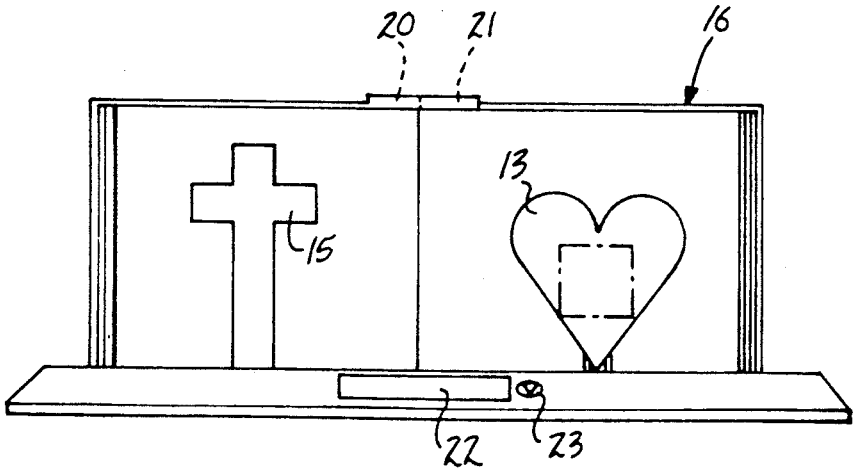

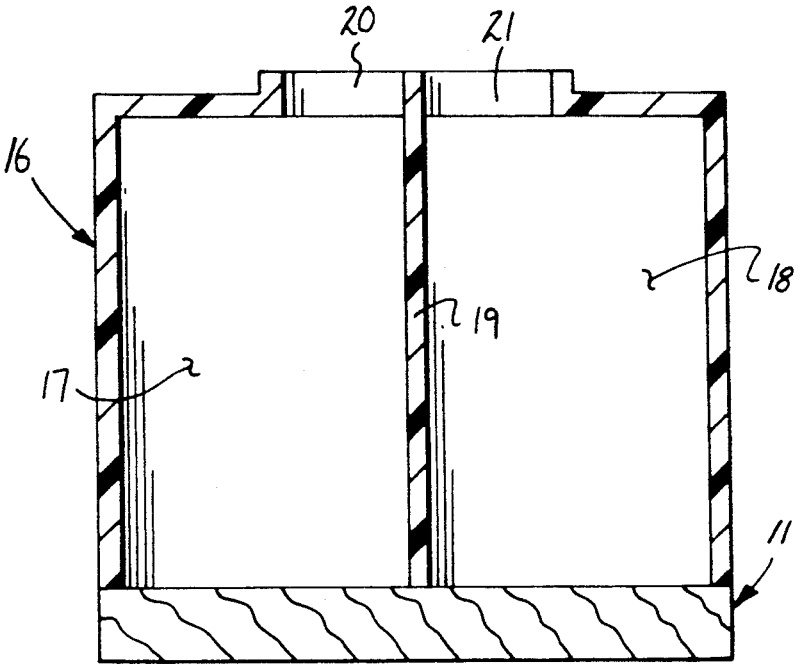
Fig 4
Fig 5
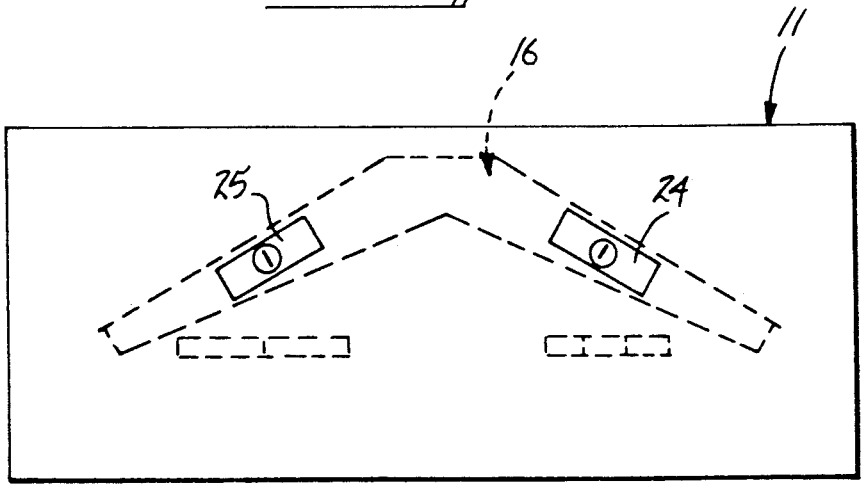

TITHING BANK APPARATUS

BACKGROUND OF THE INVENTION

1. Field of the Invention

The field of invention relates to bank apparatus, and more particularly pertains to a new and improved tithing bank apparatus wherein the same is arranged for the educational and symbolic association of an individual relative to a tithing event.

2. Description of the Prior Art

Bank structures of various types are utilized in the prior art to encourage savings and the like. The instant invention attempts to overcome deficiencies of the prior art by training and symbolic association of an individual relative to a tithing event. Examples of the prior art include U.S. Pat. No. 3,143,285 to Fulton setting forth a bank arrangement directing coins into various compartments of a bank.

U.S. Pat. No. 4,282,674 to Hansol, et al. sets forth a toy cash register forming a compartmented interior drawer for demarcating monies to various compartments of the drawer.

U.S. Pat. No. 4,454,204 to Posey sets forth a novelty bank wherein money directed into the bank may be subsequently utilized within an upper head portion of the bank as a noise maker.

U.S. Pat. No. 3,464,693 to Bailey sets forth a bank structure simulating a gambling device.

U.S. Pat. No. 3,992,805 to Arkins sets forth a budgetary savings bank, with the bank including various slots for receiving various categories of money.

As such, it may be appreciated that there continues to be a need for a new and improved tithing bank apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of bank apparatus now present in the prior art, the present invention provides a tithing bank apparatus wherein the same directs money into various chambers within the bank structure. As such, the general purpose of the present invention, which will be described subsequently in greater detail, is to provide a new and improved tithing bank apparatus which has all the advantages of the prior art bank apparatus and none of the disadvantages.

To attain this, the present invention provides a tithing bank for religious training and personal association of an individual to a tithing situation. The bank structure includes a floor, with the bank defined by simulation of a bible book, including a slot arrangement to direct a percentage of money to a tithing portion and a remaining percentage to a savings portion relative to an individual. A modification of the invention includes an adustable partition wall arranged to deflect in an adjustable manner various percentages of savings to tithing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tithing bank apparatus which has all the advantages of the prior art bank apparatus and none of the disadvantages.

It is another object of the present invention to provide a new and improved tithing bank apparatus which may be easily and efficiently manufactured and marketed.

It is a further object of the present invention to provide a new and improved tithing bank apparatus which is of a durable and reliable construction.

An even further object of the present invention is to provide a new and improved tithing bank apparatus which is susceptible of a low cost of manufacture with regard to both materials and labor, and which accordingly is then susceptible of low prices of sale to the consuming public, thereby making such tithing bank apparatus economically available to the buying public.

Still yet another object of the present invention is to provide a new and improved tithing bank apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an orthographic top view of the instant invention.

FIG. 3 is an orthographic frontal view of the instant invention.

FIG. 4 is an orthographic view, taken along the lines 4—4 of FIG. 2 in the direction indicated by the arrows.

FIG. 5 is an orthographic bottom view of the instant invention.

DESCRIPTION OF THE PREFERRED EMBODIMENT

Figure 1:
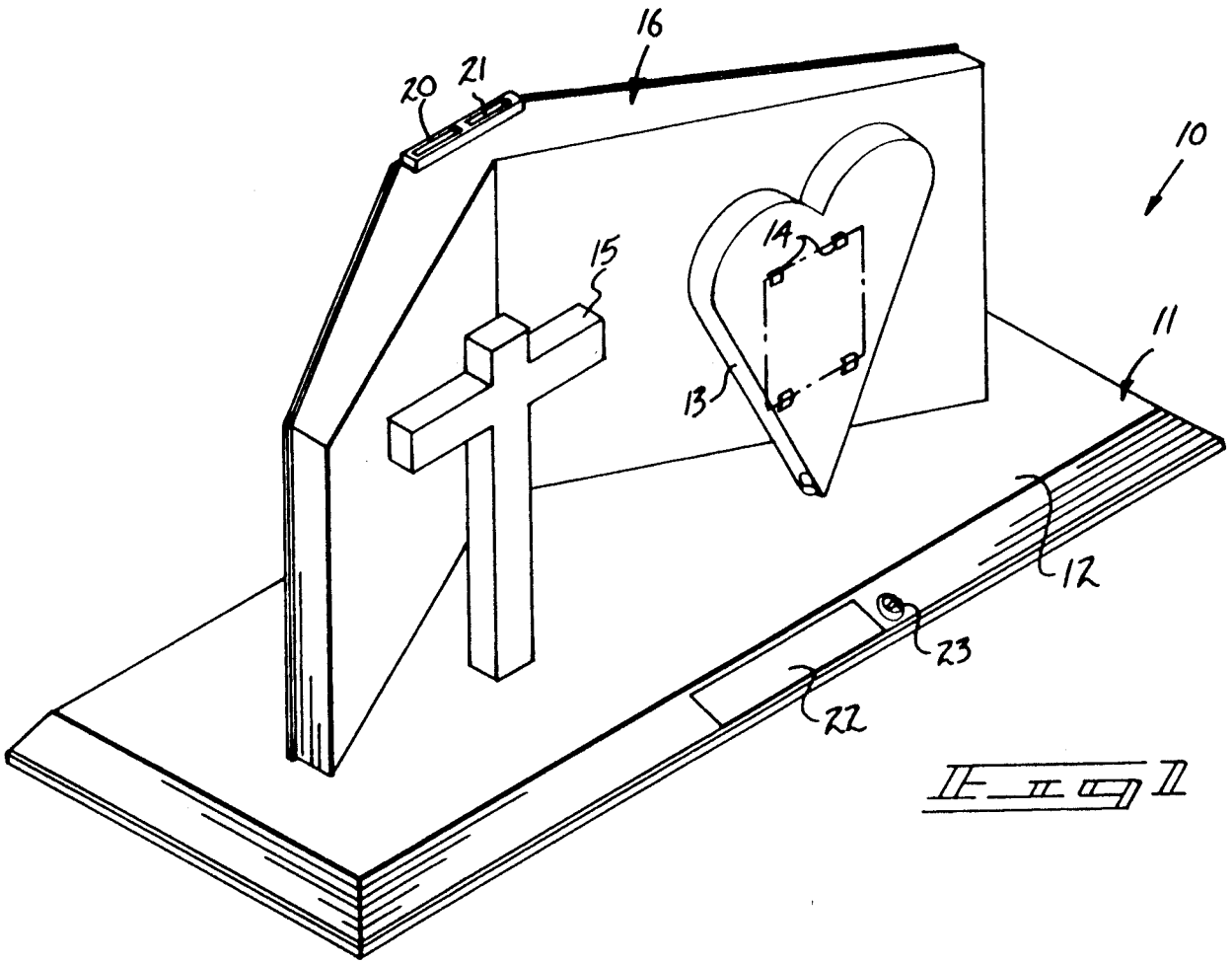
FIG. 1 is an isometric illustration of the instant invention.

With reference now to the drawings, and in particular to FIGS. 1 to 7 thereof, a new and improved tithing bank apparatus embodying the principles and concepts of the present invention and generally designated by the reference numeral 10 will be described.

More specifically, the tithing bank apparatus 10 of the instant invention essentially comprises a bank defined by a platform 11 and a platform top wall 12. The platform top wall 12 includes a first support 13 defining a planar forward face, with a plurality of mounting clip pairs 14 mounted on the planar forward face for securement of a picture and the like in association with an individual to associate the individual with the bank and training event. To this end, ar information plate 22 is positioned the platform adjacent the top wall for inscription and the like relative to the individual, such as birth date, name, and the like. A birthstone socket 23 is provided adjacent the information plate 22 for further associating in individual identity relative to the training and savings bank structure of the invention. A crucifix member 15 is positioned adjacent the first support 13 for reinforcement of religious symbology associated with the savings event. A generally "V" shaped housing 16 is orthogonally mounted to the platform top wall 12. The "V" shaped housing 16 includes a medial partition wall 19 (see FIG. 4) orthogonally mounted between the top wall 12 projecting upwardly therefrom to a slot assembly defined by a first slot 20 and a second slot 21 for directing money into the respective housing 16 and into respective first and second housing chambers 17 and 18 divided by the partition wall 19 within the hollow structure of the housing 16. FIG. 5 illustrates the use of respective first and second chamber removable floor plates 24 and 25 permitting removal of monies deposited within respective first and second chambers 17 and 18. In this manner, tithing of various percentages such as ten percent of savings may be directed into the first chamber and remaining savings into the second chamber 18.

Figure 6:
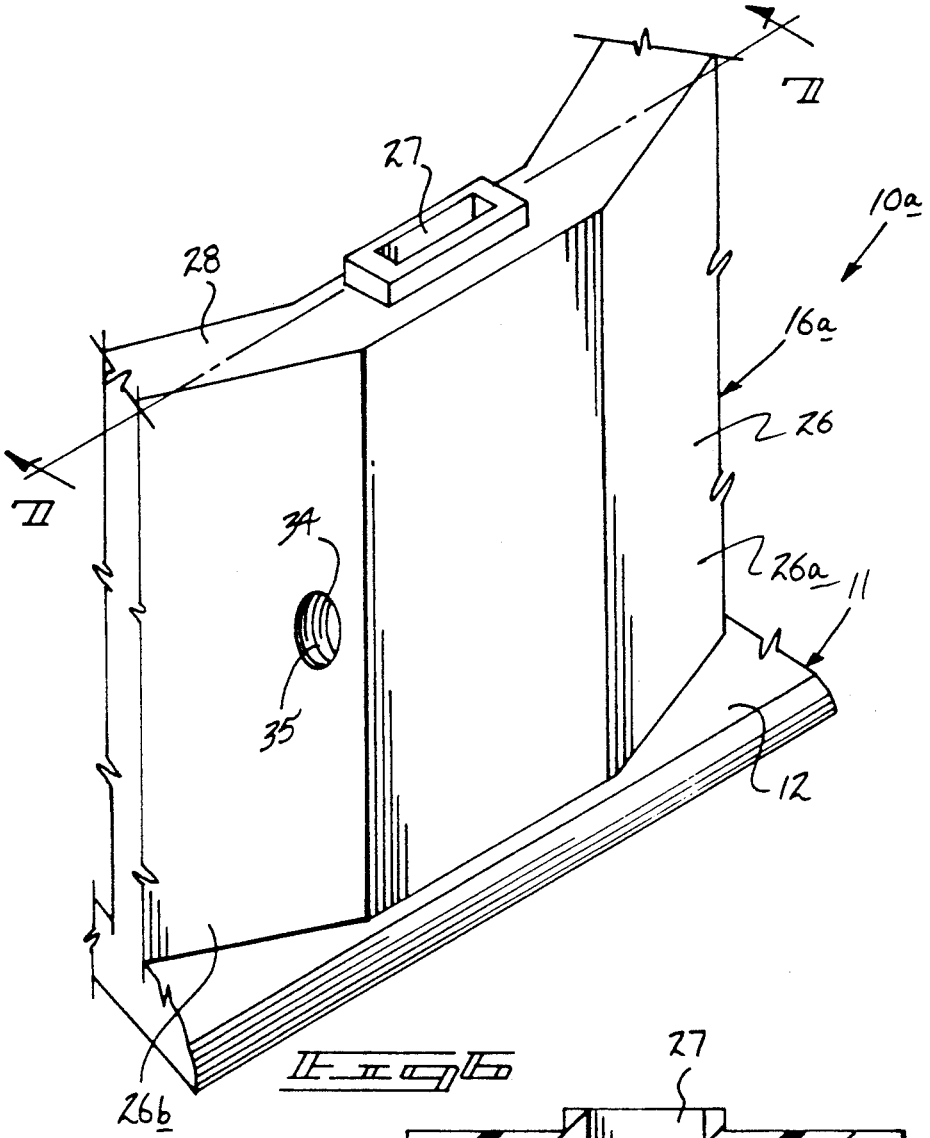
FIG. 6 is an isometric illustration of a modification of the invention.
Figure 7:
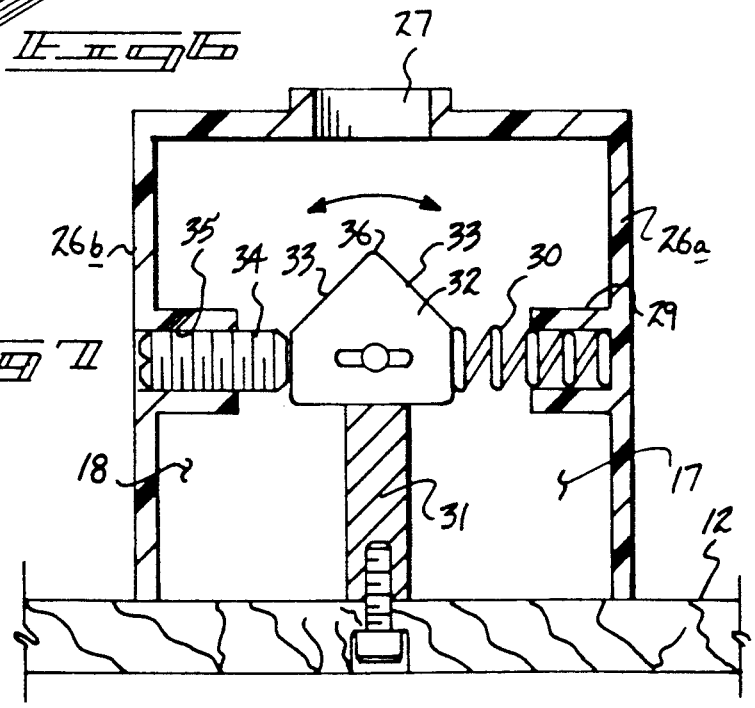
FIG. 7 is an orthographic view, taken along the lines 7—7 of FIG. 6 in the direction indicated by the arrows.

FIGS. 6 and 7 illustrate a modified apparatus 10*a*, wherein a modified housing 16*a* includes respective first and second rear panels 26*a* and 26*b* of a housing rear wall 26 that is orthogonally mounted to the top wall 12. A central receiving slot 27 is medially and orthogonally directed through the housing top wall 28. With reference to FIG. 7, the first rear panel 26*a* includes a spring socket 29 coaxially aligned with a threaded socket 35. The spring socket 29 positions a spring member 30 therewithin in a coaxially aligned relationship within the socket 29, with the spring member 30 directed against a first side wall of a deflector wedge 32. An externally threaded plug 34 threadedly received within the threaded socket 35 is directed against a second side wall of a deflector wedge 32. The deflector wedge 32 includes opposed sloping walls 33 which are directed downwardly towards opposing first and second sides of the deflector wedge 32 deflecting downwardly from a central deflecting edge 36 defining a junction of the sloping walls 33 defining the top wall configuration of the wedge. The wedge is mounted to a flexible memory retentive material partition wall 31 that is orthogonally mounted to the platform wall 12. The flexible partition wall 31 defines respective first and second chambers 17 and 18 on opposed sides thereof in association with first and second sides of the wedge 32. In this manner, placement coaxially of the threaded plug 34 relative to the threaded socket 35 deflects the wedge to provide adjustment of monies directed through the central receiving slot 27 and in this manner provide direction of a certain percentage of coins directed through the slot 27 into the respective first and second chambers to thereby demarcate savings and tithing within respective chambers.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tithing bank apparatus, comprising, a platform, the platform including a platform top wall, and a first support mounted on the platform top wall, with the first support including a plurality of mounting clip pairs fixedly secured to a forward surface of the first support for securement of informational card, and a crucifix member mounted orthogonally to the top wall adjacent the first support for religious and educational reinforcement of association of an individual relative to a tithing event, and a generally "V" shaped housing orthogonally mounted to the platform top wall rearwardly of the first support and the crucifix member, wherein the "V" shaped housing includes a first housing chamber and a second housing chamber defined within the housing positioned below a slot means for directing money into the housing, with a partition wall orthogonally mounted to the platform top wall within the "V" shaped housing defining the first housing chamber relative to the second housing chamber, with the partition wall partitioned below the slot means.

2. An apparatus as set forth in claim 1 wherein the partition wall is formed of a flexible memory retentive material, the partition wall includes a deflector wedge fixedly mounted to an upper terminal end of the partition wall, with the deflector wedge positioned below the slot means.

3. An apparatus as set forth in claim 2 wherein the deflector wedge includes a wedge first side wall spaced from a wedge second side wall, and a wedge top wall defined by downwardly sloping walls, with a wall of the downwardly sloping walls directed towards a respective first side wall and a second side wall of the wedge, and a deflector edge defining a junction of the sloping walls, with the deflector edge positioned below the slot means.

4. An apparatus as set forth in claim 3 wherein the housing includes a housing rear wall and a housing top wall, with the slot means directed through the housing top wall, and the housing rear wall including a first rear panel in confronting relationship to a second rear panel, the first rear panel including a spring socket mounted to an interior surface of the first rear panel, and an internally threaded socket mounted to an interior wall of the second rear panel, wherein the internally threaded socket and the spring socket are coaxially aligned relative to one another, and a spring member mounted within the spring socket in contiguous communication with the first side wall of the deflector wedge, and an externally threaded plug threadedly received within the internally threaded socket coaxially aligned with the spring socket in communication with the second side wall of the deflector wedge, wherein rotation of the threaded plug relative to the internally threaded socket effects deflection of the deflector wedge relative to the slot means to adjustably deflect money directed to the slot means in to the respective first and second chambers.

* * * * *